US006619626B1

(12) United States Patent
Kruschinski

(10) Patent No.: US 6,619,626 B1
(45) Date of Patent: Sep. 16, 2003

(54) METHOD FOR PRESSURE COMPENSATION IN HYDRAULIC MOTORS IN CRANE OPERATIONS

(75) Inventor: Andreas Kruschinski, Düsseldorf (DE)

(73) Assignee: Gottwald Port Technology GmbH, Düsseldorf (DE)

( * ) Notice: Subject to any disclaimer, the term of this patent is extended or adjusted under 35 U.S.C. 154(b) by 332 days.

(21) Appl. No.: 09/711,466

(22) Filed: Nov. 13, 2000

(30) Foreign Application Priority Data

Nov. 11, 1999 (DE) ..... 199 55 750

(51) Int. Cl.[7] ..... B66D 1/08
(52) U.S. Cl. ..... 254/361
(58) Field of Search ..... 254/360, 361

(56) References Cited

U.S. PATENT DOCUMENTS 4,047,311 A * 9/1977 Kelley ..... 37/309
4,132,387 A * 1/1979 Somerville et al. ..... 254/340
4,224,791 A * 9/1980 Ostwald ..... 60/397
5,044,608 A * 9/1991 Hidaka et al. ..... 254/266
5,319,932 A * 6/1994 Roche ..... 60/419
5,520,368 A * 5/1996 Braesch et al. ..... 254/274
5,734,112 A * 3/1998 Bose et al. ..... 73/861.56
5,806,838 A * 9/1998 Kalve et al. ..... 254/361
6,371,447 B1 * 4/2002 Imanishi et al. ..... 254/361
6,389,950 B1 * 5/2002 Kuhn et al. ..... 91/31

FOREIGN PATENT DOCUMENTS

JP 4-327497 11/1992

* cited by examiner

*Primary Examiner*—Emmanuel Marcelo
(74) *Attorney, Agent, or Firm*—Cohen, Pontani, Lieberman & Pavane

(57) ABSTRACT

A method for pressure compensation in reversible motors used to drive hoisting cables and closing cables of a cable operated crane is provided. The method includes connecting a hydraulic motor to hoisting cables, connecting another hydraulic motor to closing cables, connecting the hydraulic motors to a common pressure medium source via delivery lines, performing a closing operation of a grab of the crane while simultaneously detecting working pressures in working circuits of the hydraulic motors, adjusting the working pressures during the closing operation using a control so that during the grab the working pressures are substantially equal to one another. The present invention also provides a device for pressure compensation in reversible motors for driving hoisting cables and closing cables of a cable operated crane.

4 Claims, 1 Drawing Sheet

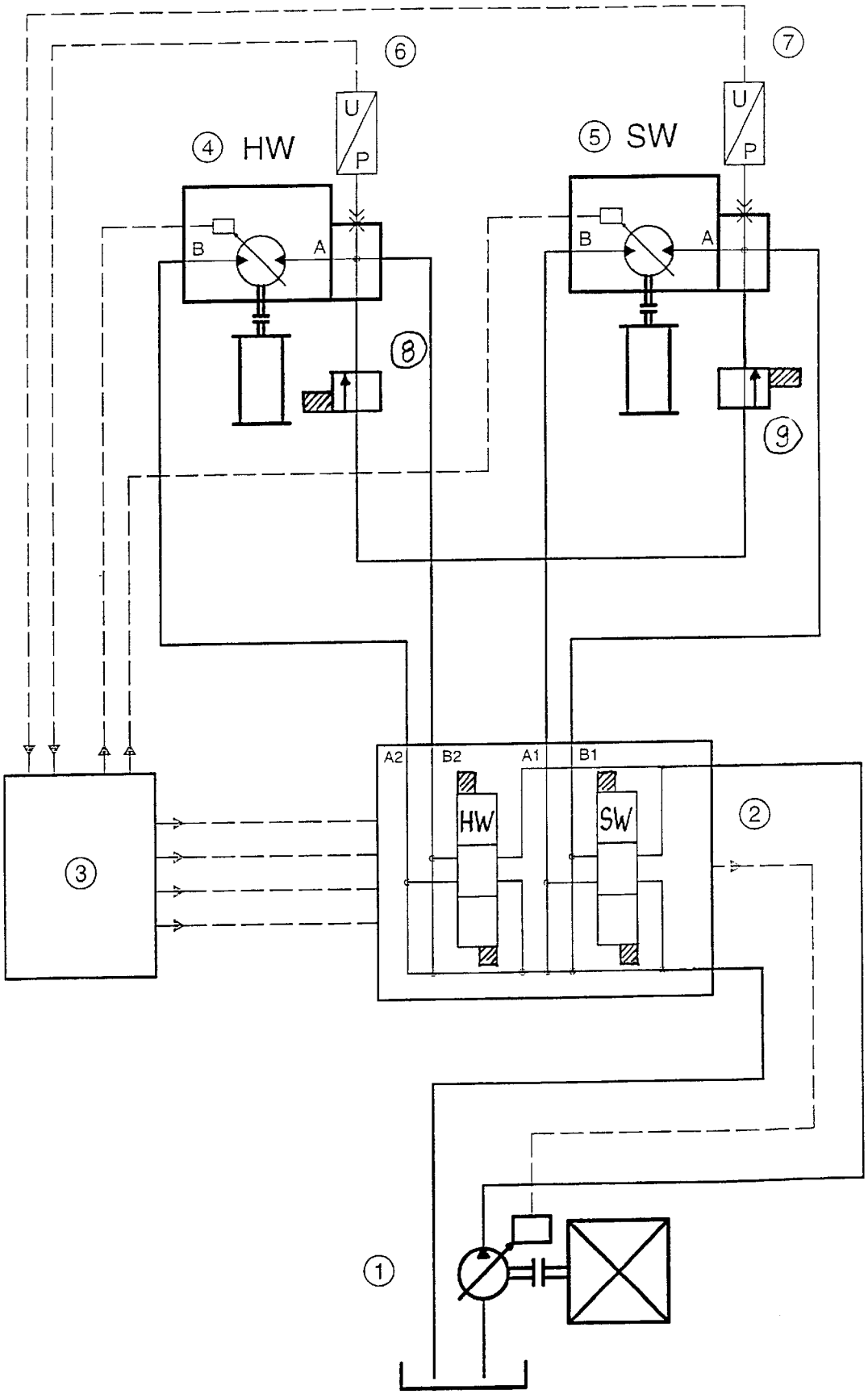
6
7
U
P
U
P
4 HW
5 SW
B
A
B
A
8
9
A2
B2
A1
B1
HW
SW
2
3
1

METHOD FOR PRESSURE COMPENSATION IN HYDRAULIC MOTORS IN CRANE OPERATIONS

BACKGROUND OF THE INVENTION

1. Field of the Invention

The present invention relates to a method for pressure compensation in the reversible hydraulic motors used to drive hoisting and closing cables of a cable operated crane, where the crane has, for example, a grab for picking up bulk material.

2. Description of the Related Art

In order to transfer bulk materials, grabs are often used, i.e., conveying vessels that can penetrate into a bulk or batch material, grasp it, pick it up, and empty it again above a discharge point. The grabs can consist, for example, of shovels articulated on a common crossmember that are placed, open, onto the batch material. As a result of the deadweight of the grab during closure the shovels penetrate into the batch material and are at the same time filled. There are different types of grabs, depending on the way in which closing of the shovels is performed.

Conventional cranes of this type use two cable operated grabs, in which two cables or pairs of cables, operating independently from one another, bring about the movement of the shovels. When pairs of cables are used the system is referred to as a four-cable grab. This type of grab requires a special grab winch with two drums which are driven predominately by means of reversible hydraulic motors.

Two-cable or four-cable grabs are operated by means of the two cables or pairs of cables. The open grab is placed onto the material to be grabbed with the closing cable slack. When the slack of the closing cables is taken up, the shovels are closed as a result of the kinematics of the grab. In order to cause the grab to penetrate under the effect of its deadweight into the batch material, the holding cable must from the beginning, be made slack or eased down during the closing operation. After the shovels are closed, the gripper is raised, slack in the closing cables is further taken up, and the holding cable must be made taut. This presents a problem during closing of the grab in the bulk material, in that the holding cables have a slack cable, specifically with cable lengths which are different during each hoist. At the same time, the closing cables are highly taut due to the closing operation. This results in pronounced pressure differences between the working circuits of the two hydraulic motors used for the hoisting cable or pair of hoisting cables and the closing cables or pair of closing cables.

If pressure compensation is cut after closing the grab shovels to reverse the hoisting motors, then the hydraulic motor for the closing cable would first be drawn through in the wrong direction. As a result, cavitation phenomena occurs in the hydraulic motor when the pressure in the working circuit of the hydraulic motor for the closing cable is switched over to the hydraulic motor for the holding cable. Frequent cavitations in the system cause damage to the hydraulic motors which have to be switched on and off repeatedly or changed over during the operation of the grab crane.

SUMMARY OF THE INVENTION

The object of the present invention is to provide a method and a device for pressure compensation in reversible hydraulic motors used for driving the hoisting and closing cables of a generic cable operated crane. More particularly, it is an object of the present invention to provide a method and device for eliminating damage to hydraulic motors that occurs due to cavitation.

In order to achieve the object according to the present invention, the working pressure in the working circuit of each hydraulic motor is detected and is adjusted via a control while a closing movement of the grab is being initiated so that by the end of the operation of closing the grab, identical working pressures exist on each hydraulic motor.

The present invention affords a solution which from the outset prevents pronounced pressure differences on the two hydraulic motors assigned to the different cables. As a result, the undesirable cavitation phenomena cannot occur in the motors. Instead, as early as during the operation of closing the grab, the working pressure detected in the working circuit of each hydraulic motor is used to bring about pressure compensation via a control, so that, at the end of the closing operation, compensation of the working pressures has taken place. When the hydraulic motors are then reversed in order then to raise the grab after the closing operation has been performed further pressure compensation is no longer necessary.

A device for performing the method according to the present invention includes a sensor inserted into each delivery line leading to the respective hydraulic motors for detecting the working pressure prevailing in the line. The sensors are connected to a control unit in order to process the signals representing the detected working pressure. The control unit is connected to a control block which compensates the working pressures in the delivery lines leading to their respective hydraulic motors.

Other objects and features of the present invention will become apparent from the following detailed description considered in conjunction with the accompanying drawing. It is to be understood, however, that the drawing is designed solely for purposes of illustration and not as a definition of the limits of the invention, for which reference should be made to the appended claims. It should be further understood that the drawing is not necessarily drawn to scale and that, unless otherwise indicated, is merely intended to conceptually illustrate the structures and procedures described herein.

BRIEF DESCRIPTION OF THE DRAWINGS

FIG. 1 is a circuit diagram of a pressure compensating system according to the present invention.

DETAILED DESCRIPTION OF THE PRESENTLY PREFERRED EMBODIMENTS

Referring now to FIG. 1, a simplified circuit diagram of a hydraulic circuit according to the present invention is shown. The hydraulic motors 4, 5 can be activated by a control 3 for the regulateable pump 1 via a control block 2 which provides pressure independent proportional control of a plurality of consumers. The hydraulic motors 4, 5 include a hydraulic motor 4 assigned to the hoisting cable HW and a hydraulic motor 5 assigned to the closing cable SW. The motors 4, 5 are connected to one another via a pressure compensation line, into which are inserted sw/ws valves 8, 9 which initiate the pressure compensation, while the grab is being closed or during the raising and lowering of the load, i.e., piece goods.

Detection of the working pressures in the hydraulic motors 4, 5 according to the present invention is performed by sensors 6, 7 which are assigned to the hydraulic motors 4, 5, respectively. These sensors 6, 7 conduct signals proportional to the working pressures into the control 3 which then activates the hydraulic motors 4, 5 and the control block 2. As a result, at the end of the grab closing, identical working pressures are established in the hydraulic motors 4, 5.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A method for pressure compensation in reversible motors for driving hoisting cables and closing cables of a cable operated crane having a grab, the method comprising the steps of:

connecting a first hydraulic motor to a plurality of hoisting cables;

connecting a second hydraulic motor to a plurality of closing cables;

connecting the first hydraulic motor and the second hydraulic motor to a common pressure medium source via delivery lines;

detecting a first working pressure in a first working circuit of the first hydraulic motor and a second working pressure in a second working circuit of the second hydraulic motor when closing movement of the grab is initiated; and adjusting the first working pressure and the second working pressure during closing so that when the closing movement ends the first working pressure and the second working pressure are substantially equal to one another.

2. The method according to claim 1, wherein the first connecting step includes connecting the first hydraulic motor to two hoisting cables; and the second connecting step includes connecting the second hydraulic motor to two closing cables.

3. A device for pressure compensation in reversible motors for driving hoisting cables and closing cables of a cable operated crane having a grab, a first hydraulic motor and a second hydraulic motor, the device comprising:

a first sensor connectable to the first hydraulic motor for detecting a first working pressure;

a second sensor connectable-to the second hydraulic motor for detecting a second working pressure;

a control unit interposed between the first and second sensors; and a control block operatively attached to the control unit, whereby the control block responds to signals produced by the first and second sensors by compensating the first and second working pressures, wherein the control block is adapted to render the first working pressure and the second working pressure to be approximately equal during a grabbing operation of a crane.

4. A combination, comprising:

a crane comprising a grab, a first hydraulic motor, a plurality of hoisting cables connected to the first hydraulic motor, a second hydraulic motor, a plurality of closing cables connected to the second hydraulic motor and a common pressure medium source interposed between the first hydraulic motor and the second hydraulic motor via at least a first and a second delivery line, respectively; and pressure compensation device comprising a first sensor arranged in the first delivery line for detecting a first working pressure, a second sensor arranged in the second delivery line for detecting a second working pressure, a control unit interposed between the first and second sensors, and a control block operatively attached to the control unit, whereby the control block is configured to compensate the first and second working pressures in response to signals produced by the first and second sensors, and wherein the control block is adapted to render the first working pressure and the second working pressure to be approximately equal during a grabbing operation of the crane.

* * * * *